US008033069B2

(12) United States Patent
Hotchkiss, III

(10) Patent No.: US 8,033,069 B2
(45) Date of Patent: Oct. 11, 2011

(54) EMBEDDED CLIP ATTACHMENT FOR CAST ARCHITECTURAL ELEMENT

(75) Inventor: Wesley E. Hotchkiss, III, Auburn, CA (US)

(73) Assignee: United States Gypsum Company, Chicago, IL (US)

( * ) Notice: Subject to any disclaimer, the term of this patent is extended or adjusted under 35 U.S.C. 154(b) by 478 days.

(21) Appl. No.: 12/113,605

(22) Filed: May 1, 2008

(65) Prior Publication Data

US 2009/0272057 A1 Nov. 5, 2009

(51) Int. Cl.

| | |
|---|---|
| ***E04C 1/41*** | (2006.01) |
| ***B29C 70/72*** | (2006.01) |
| ***B29C 70/70*** | (2006.01) |
| ***B28B 1/16*** | (2006.01) |
| *E04F 13/14* | (2006.01) |
| *E04F 13/21* | (2006.01) |

(52) U.S. Cl. ..... 52/405.3; 52/309.12; 52/309.17; 52/511; 264/46.6; 264/256; 264/267

(58) Field of Classification Search ..... 52/309.17, 52/309.14, 309.12, 405.3, 405.4, 405.2, 405.1, 52/509, 511, 512, 601; 264/46.6, 133, 250, 264/256, 259, 267

See application file for complete search history.

(56) References Cited

U.S. PATENT DOCUMENTS

| | | | | |
|---|---|---|---|---|
| 1,276,894 | A | | 8/1918 | Flanders |
| 1,396,764 | A | | 11/1921 | Lancaster |
| 1,399,023 | A | | 12/1921 | Murray |
| 3,376,681 | A | | 4/1968 | Demaison |
| 3,512,327 | A | | 5/1970 | Padura |
| 4,480,416 | A | * | 11/1984 | Judkins et al. ..... 52/376 |
| 5,095,674 | A | * | 3/1992 | Huettemann ..... 52/405.3 |
| 5,265,396 | A | | 11/1993 | Amimoto |
| 5,974,762 | A | | 11/1999 | Rodgers |
| 6,282,853 | B1 | | 9/2001 | Blaney et al. |
| 6,857,241 | B1 | | 2/2005 | Pellicer |
| 2004/0182026 | A1 | | 9/2004 | Clarke |
| 2007/0062143 | A1 | | 3/2007 | Noushad |
| 2007/0130860 | A1 | | 6/2007 | Paquette et al. |

FOREIGN PATENT DOCUMENTS

| | | |
|---|---|---|
| KR | 10-2005-0075482 | 7/2005 |
| KR | 10-2006-0114557 | 11/2006 |

* cited by examiner

*Primary Examiner* — Michael Safavi

(74) *Attorney, Agent, or Firm* — Greer, Burns & Crain, Ltd.; Pradip Sahu; Philip T. Petti

(57) ABSTRACT

A cast architectural element is provided, including a stone shell having front, end, side and rear walls defining an internal cavity, the rear walls defining a rear opening. A core is disposed in the internal cavity, and at least one attachment clip is provided having a first portion extending from the shell, and a second portion engaged in the core. A layer of mesh is disposed upon the core and the second clip portion, and a settable filler layer is disposed upon the mesh in the rear opening, such that upon setting, the filler retains the clip in position.

9 Claims, 7 Drawing Sheets

EMBEDDED CLIP ATTACHMENT FOR CAST ARCHITECTURAL ELEMENT

BACKGROUND OF THE INVENTION

The present invention generally relates to cast architectural elements, and more specifically to such elements used as simulated stone blocks for replacing more expensive and heavy solid ornamental stone on building exteriors and interiors.

For reasons of esthetics, lower maintenance and/or fire retardant properties, stone exteriors are preferred. However, due to the relatively high cost of the stone, particularly blocks of granite, marble or even limestone, as well as the technical challenge of handling and securing stone blocks to building substrates, there has been a demand for architectural elements made of simulated or artificial stone. Also, with the current interest in preserving resources, the use of solid stone blocks requires significantly more fuel for transportation due to vehicle weight restrictions. In many cases, cast architectural elements have a facing of relatively expensive pure or composite stone, with backings of less expensive, and typically relatively lighter weight materials.

One such product is a foam core architectural element that is coated to resemble stone and is sold under the trademark ELEGANT STONE™ by L&W Supply of Chicago, Ill. (www.lwsupply.com). As is well known in the art, such products include an exterior surface of ornamental stone, such as limestone, marble, quartz, silica or the like in a cement matrix with aggregate in a castable formulation. Using a known foam casting technique, the element is produced so that the exterior shell is fused to an interior core of expanded polystyrene foam (EPS). The interior core is thus significantly lighter and easier to handle and install than conventional solid stone blocks. Also, this type of architectural element costs a fraction of solid stone.

Conventional cast architectural elements are secured to building exterior or interior substrates using adhesive and/or clamps which are fastened to the building substrate and grip the cast element in a peripheral groove. However, a drawback of such clips is that the installer needs to assemble them on site, and each clip requires multiple components which must be inventoried on site, and are easily misplaced during construction.

BRIEF SUMMARY OF THE INVENTION

The above-identified drawbacks of conventional cast architectural elements are met or exceeded by the present embedded clip attachment for a cast architectural element, which features the ability to install such elements on building exterior or interior substrates with fasteners as well as adhesive. With the present attachment, an attachment clip is embedded in the interior of the block, and is virtually impossible to pull out without destroying the block. In addition, the present attachment fully encases the foam core in stone or cement or settable matrix. A single integral clip has a portion for accommodating a fastener for securing the block to the building exterior or interior, and a second portion for engaging the foam core.

More specifically, a cast architectural element is provided, including a stone shell having front, end, side and rear walls defining an internal cavity, the rear walls defining a rear opening. A core is disposed in the internal cavity, and at least one attachment clip is provided having a first portion extending from the shell, and a second portion engaged in the core. A layer of mesh is disposed upon the core and the second clip portion, and a settable filler layer is disposed upon the mesh in the rear opening, such that upon setting, the filler retains the clip in position.

In another embodiment, a method of forming a cast architectural element is provided and includes the steps of providing a pre-cast element having a front, end, side and rear walls defining an internal cavity, the rear walls defining a rear opening, and forming edges of the rear walls to angle inwardly; providing a foam core disposed in the internal cavity; providing at least one attachment clip having a first portion extending from the shell, and a second portion with at least one tooth configured for insertion into the core, and placing the clips on said element so that the second portion engages the core; placing a layer of mesh upon the core and the second clip portion, so that edges of the mesh are beneath an inner corner of each edge; and applying a settable filler layer upon the mesh in the rear opening, such that upon setting, the filler retains the clip in position.

In yet another embodiment, a clip for use in securing a cast architectural element to a substrate is provided, wherein the element has a stone shell having front, end, side and rear walls defining an internal cavity, the rear walls defining a rear opening, a core is disposed in the internal cavity, a layer of mesh is disposed upon the core, and a settable filler layer is disposed upon the mesh in the rear opening, such that upon setting, the filler retains the clip in position. The clip includes a first clip portion with an eyelet, a second clip portion with at least one core engaging tooth, a transition portion between the first and second clip portions which axially displaces the first and second portions, which are parallel to each other.

DETAILED DESCRIPTION OF THE INVENTION

Figure 1:
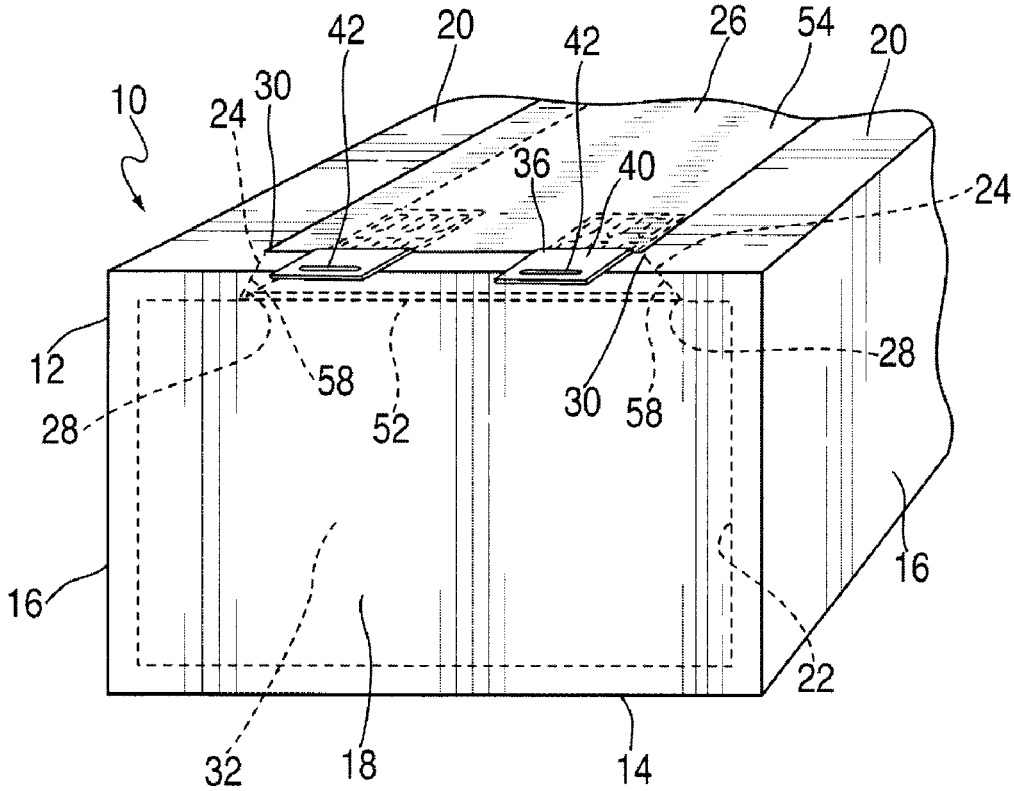
FIG. 1 is a fragmentary top perspective view of the present block with embedded clip.

Referring now to FIGS. 1-4, a cast architectural element is generally designated 10 and is shown as an ornamental facade construction block; however other types of cast architectural elements are contemplated, including but not limited to trim pieces, moldings, baseboard moldings, mantles, wainscoting, window sills, window jams, columns, column bases, column caps, cornices, headboards, and the like. Included on the element 10 is a stone shell 12 having a front wall 14, a pair of side walls 16, a pair of end walls 18, and a pair of rear walls 20 defining an internal cavity 22 (shown hidden). The rear walls 20 each have a corresponding edge 24 spaced from each other to define a rear opening 26. It will be seen in FIG. 1 that the edges 24 are angled inwardly so that an inner corner 28 of each edge is closer to an adjacent one of the side walls 16 than an outer corner 30.

A core 32 is disposed in the internal cavity 22, and as is known in the art, the core is made of expanded polystyrene foam (EPS) which becomes fused to inner surfaces of the stone shell 12 through the casting process. The stone shell 12 is preferably made of a cement matrix with aggregate, as described above, and may be made of marble, quartz, limestone, silica or the like, as well as mixtures of the above. Prior to further assembly, approximately ⅜-⅝ inch (0.9525-1.588 cm) of the core 32 is removed from the rear edge 24, creating a recess 34 in the core (FIG. 2).

Figure 2:
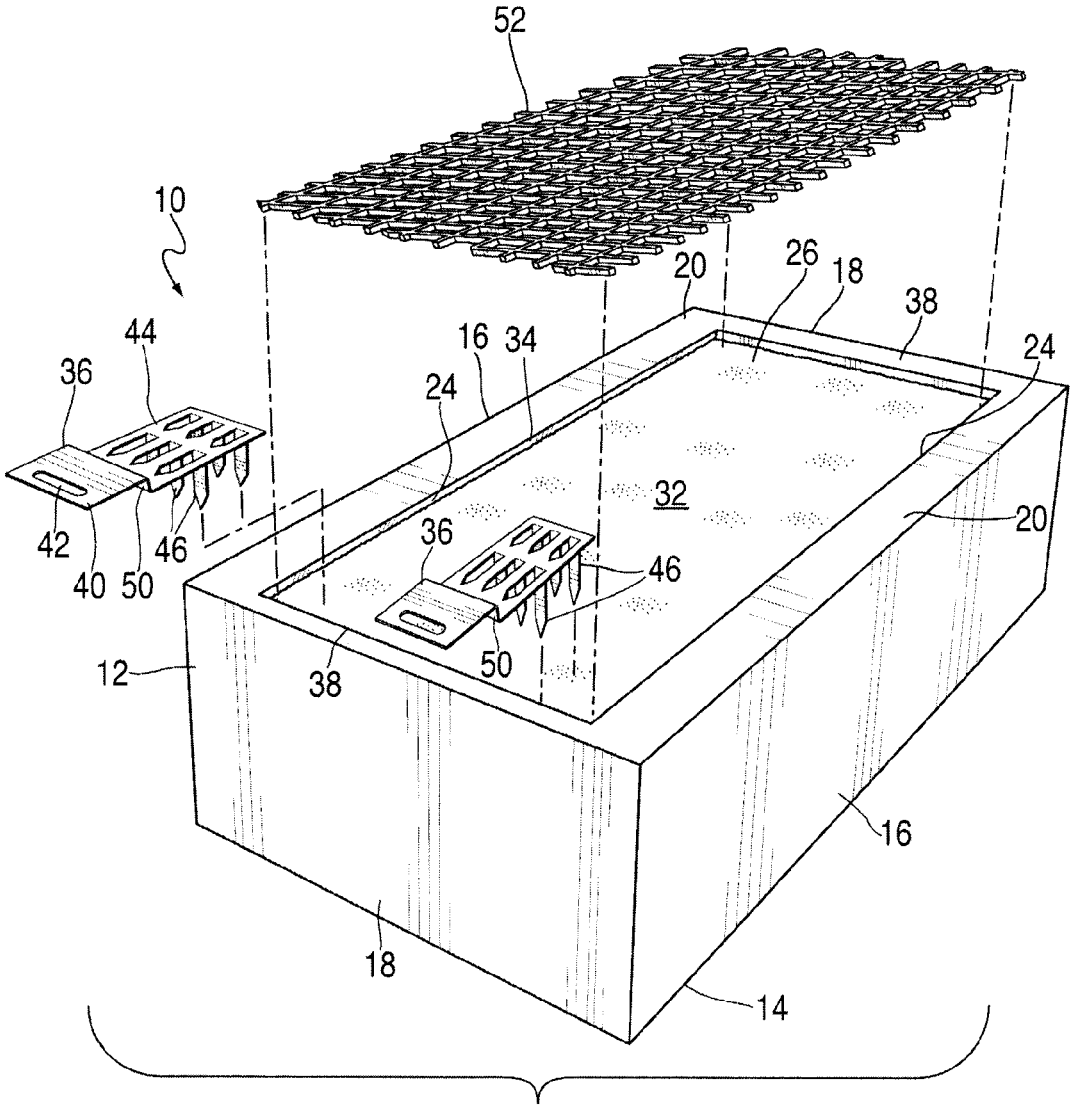
FIG. 2 is an exploded perspective view of the block of FIG. 1.
Figure 3:
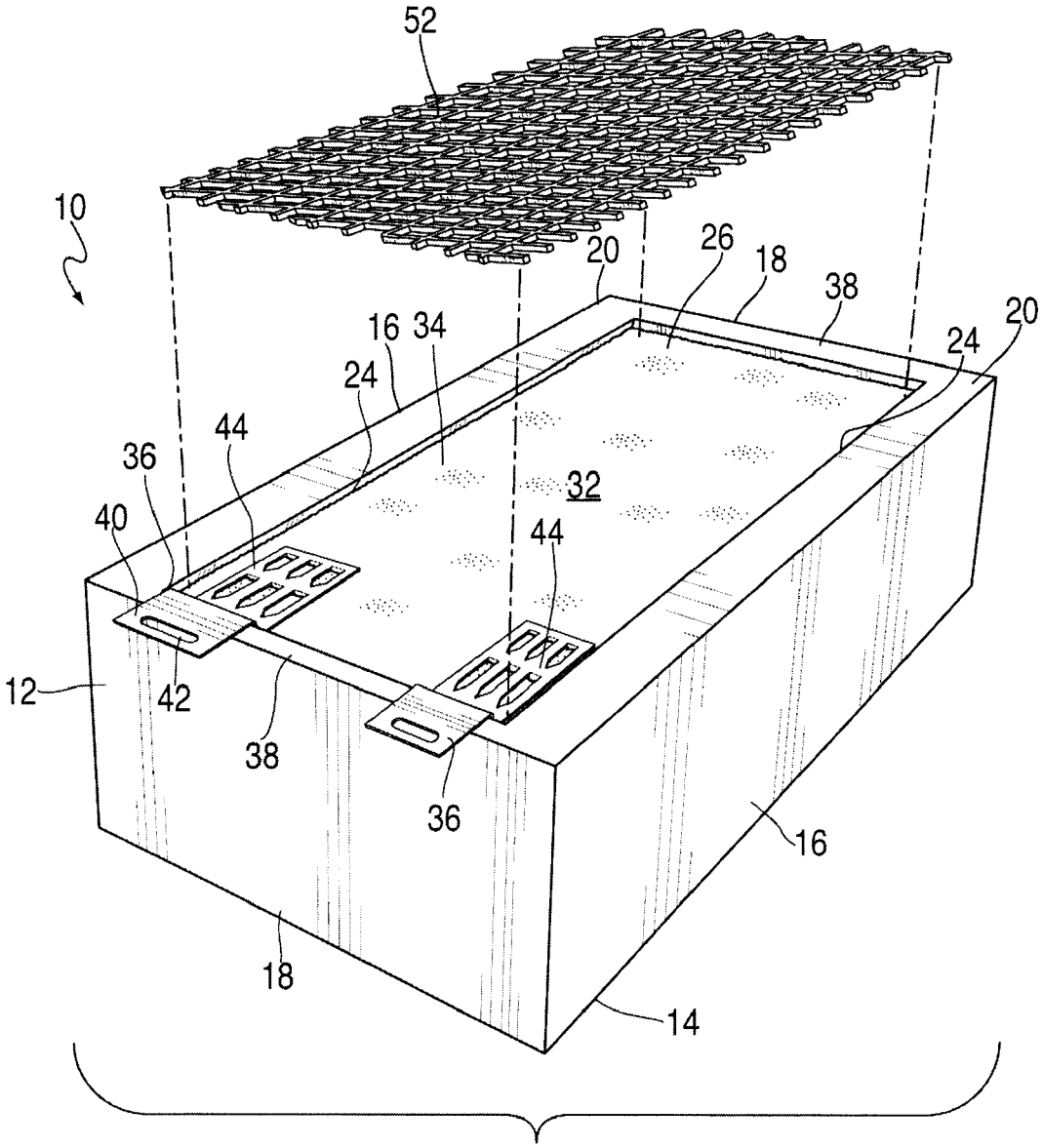
FIG. 3 is a partially exploded view of the block of FIG. 2.
Figure 4:
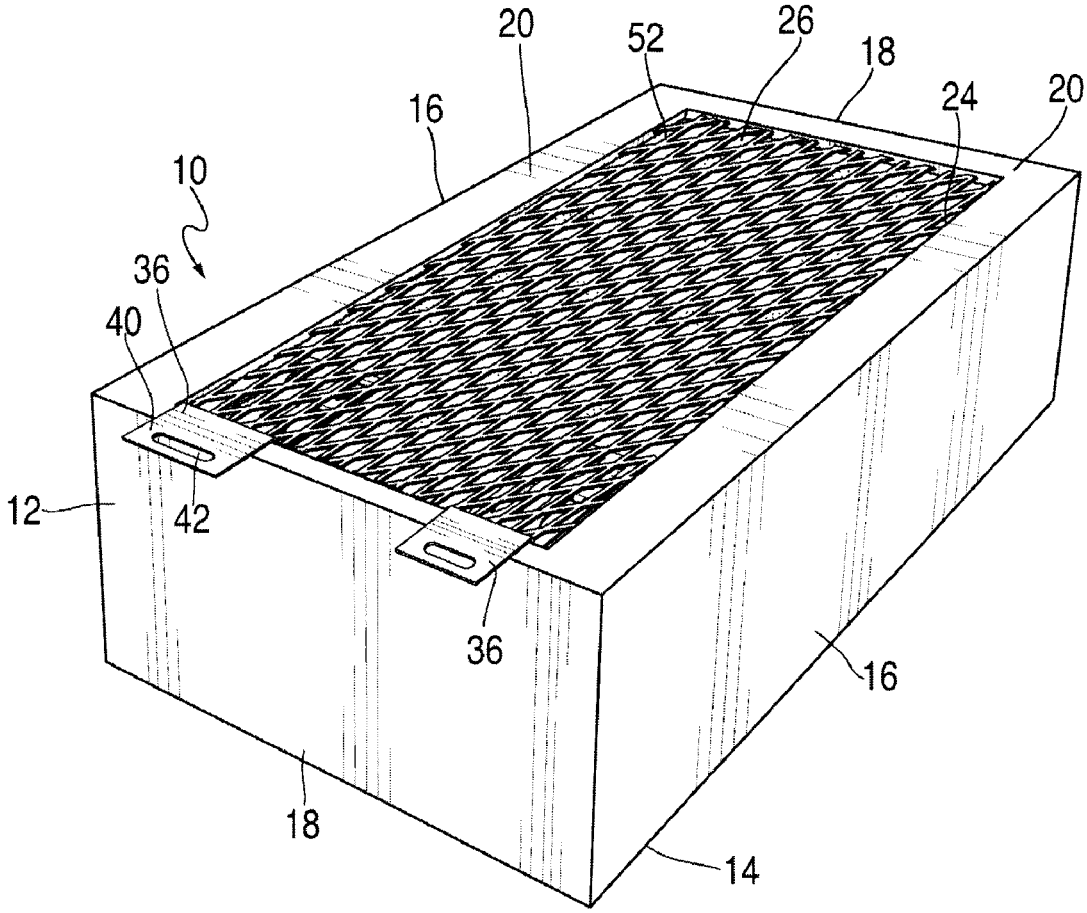
FIG. 4 is a top perspective view of the present block partially assembled.
Figure 7:
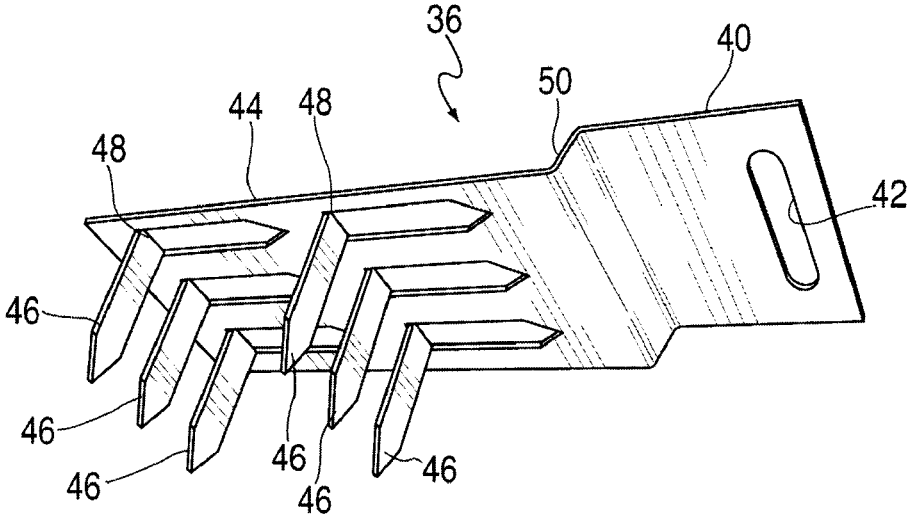
FIG. 7 is a bottom perspective of a clip suitable for use with the present block.

Referring now to FIGS. 2, 3 and 7, at least one and preferably a pair of attachment clips 36 are placed on a rear ledge 38 formed by the end walls 18. In total, each cast element 10 will preferably have four attachment clips 36, a pair at the upper edge and a pair at the lower edge. However, the number and placement of the clips 36 may vary to suit the application.

Each clip 36 has a first portion 40 resting on the ledge 38, extending from the shell 12 and defining at least one eyelet 42. A second portion 44 is engaged in the core 32. In the preferred embodiment, the engagement takes the form of at least one and even more preferably a plurality of pointed teeth 46, which are provided in parallel rows 48, each row having multiple teeth. It will be seen that the teeth 46 are preferably all about the same length and are provided in a length sufficient to securely engage the core 32. In the preferred embodiment, the teeth 46 are approximately 1 inch (2.5 cm) long and are stamped from the second portion 44 and bent into an approximate perpendicular orientation thereto. However, other dimensions, fabrication techniques are contemplated depending on the application.

Between the first and second portions 38, 42 a transition portion 50 is provided which axially displaces or offsets the first and second portions, which are also preferably parallel to each other. In the clip 36, which is preferably an integral unit, the transition portion 50 is integral with the first and second portions 40, 44, being stamped from a single piece of 14 Gauge galvanized or stainless steel or material with similar strength and corrosion-resistant properties.

The present cast architectural element 10 further includes a layer or sheet of mesh 52 disposed upon the core and the second clip portions 44 of each of the clips 36. It will be seen that the mesh 52 is disposed below the inner corner 28 (FIG. 1). It is preferred that the mesh 52 is 2.5 ounce per square foot (0.763 kg/m$^2$) galvanized expanded metal lath or the like. The weight and material of the mesh 52 may vary to suit the application. A main function of the mesh 52 is to provide a matrix for supporting a layer of settable filler 54, which is disposed upon the mesh in the rear opening 26.

Figure 5:
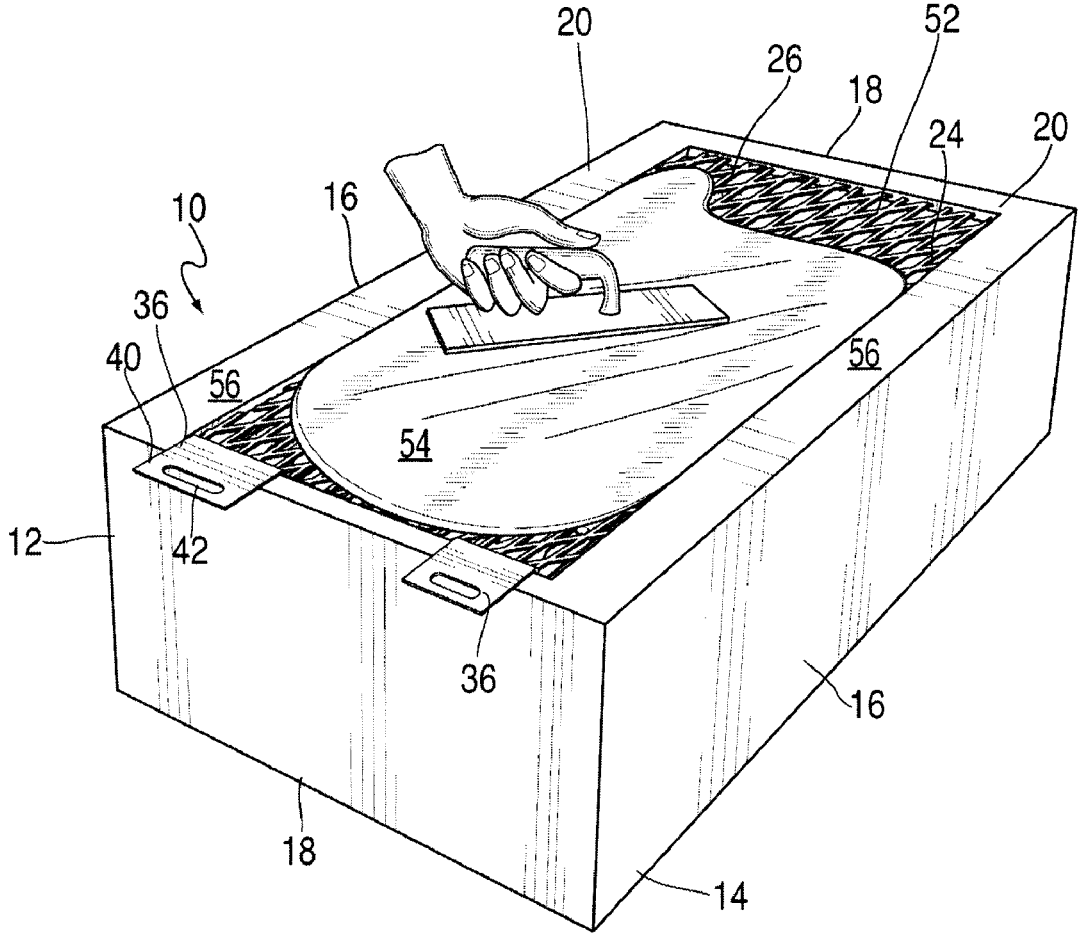
FIG. 5 is a top perspective view of the final assembly of the present block.
Figure 6:
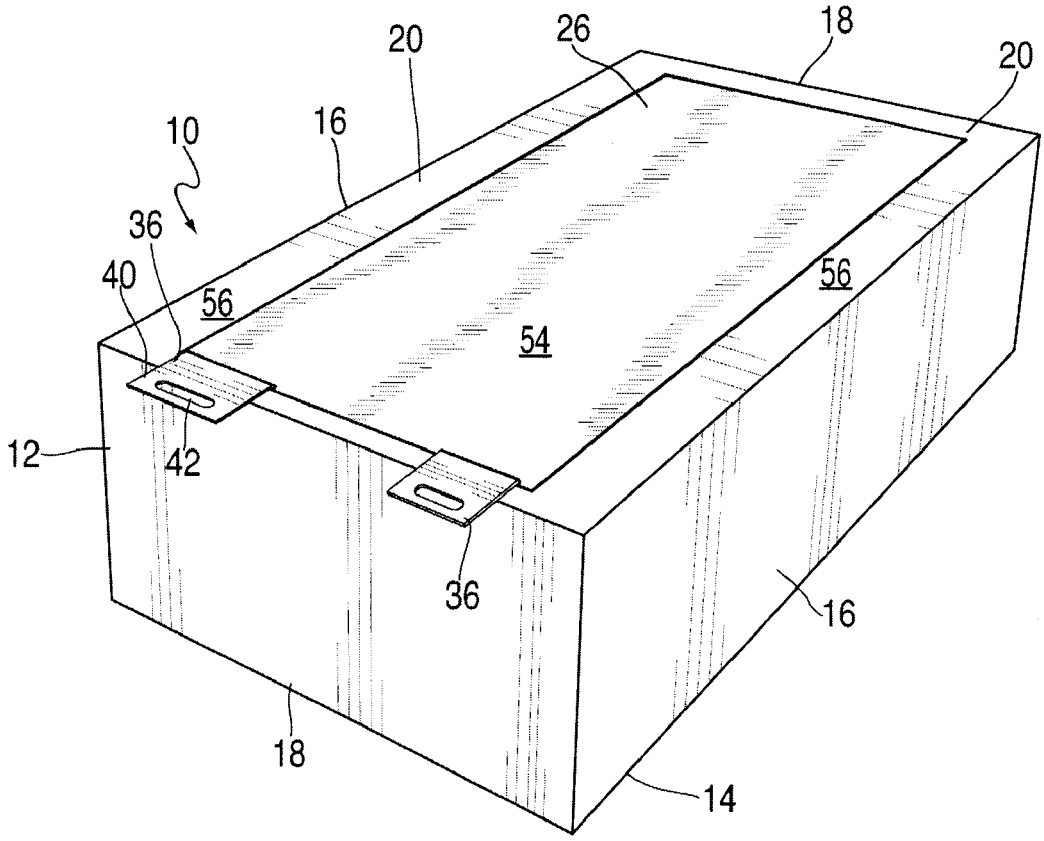
FIG. 6 is a top perspective of the block of FIG. 6 fully assembled.

Referring now to FIGS. 1, 5 and 6, the filler 54 is preferably a settable, workable material that can be troweled upon the layer of mesh 52, and most preferably is cement-based stucco. The filler 54 is applied in a sufficient amount and consistency to become flush with an exterior surface 56 of the rear walls 20. It is important for achieving the desired properties of the present cast architectural element 10 that the filler 54 be applied so that peripheral edges 58 engage the angled inner edges 24 of the rear walls 20 (FIG. 1). Thus, upon setting, the filler 54 will bond with the shell 12, will be supported by the mesh 52, and will encapsulate the clips 36 as well as the core 32. Also, the set filler 54 will be retained in position in the element 10 by virtue of the angled edges 24.

Figure 8:
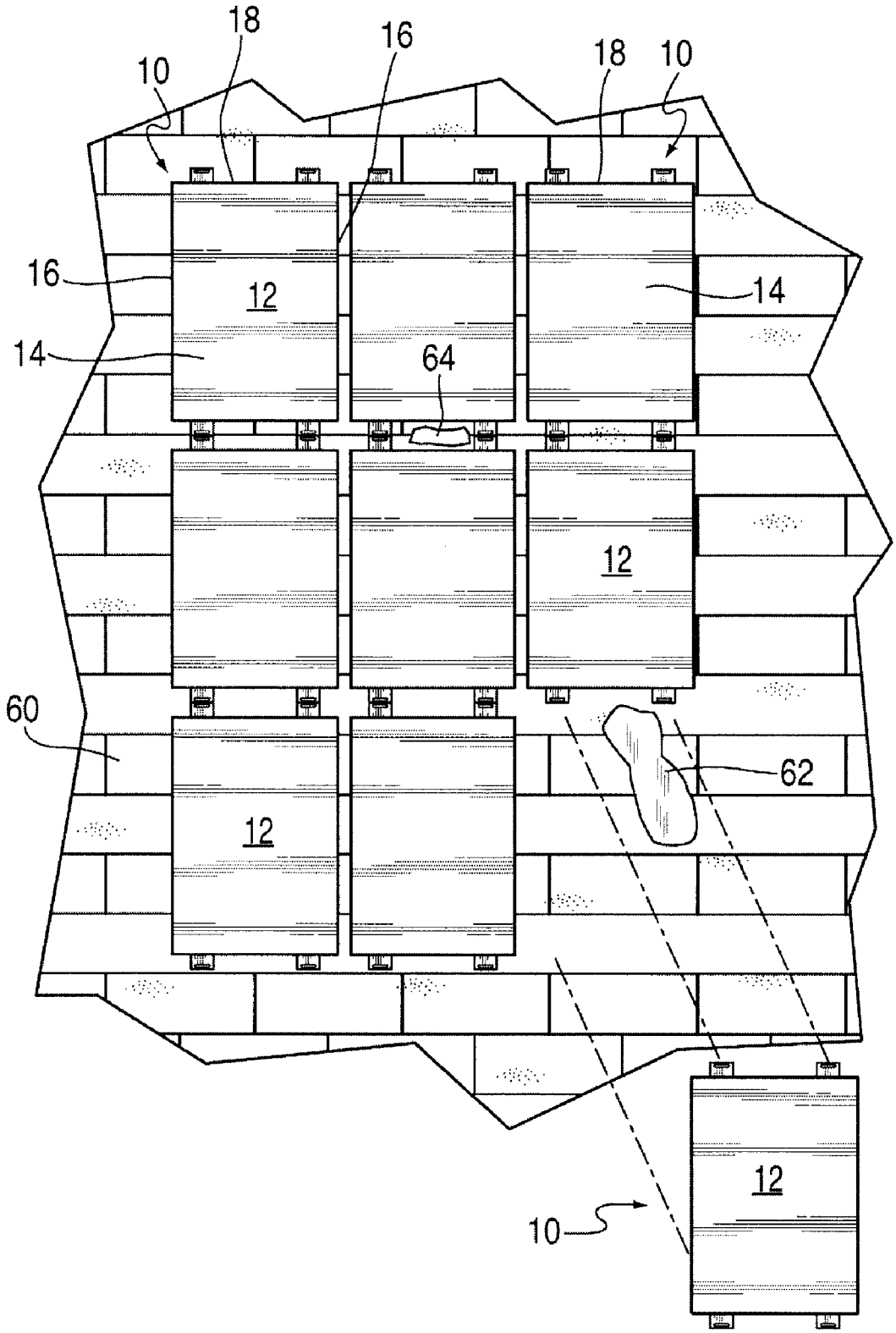
FIG. 8 is a fragmentary elevation of a wall having a plurality of the present blocks attached thereto.

Referring now to FIG. 8, the manner of securing the present cast architectural elements 10 to a building exterior, interior or other substrate 60 is shown. Fasteners (not shown) engage the eyelets 42 and the building substrate 60. In addition, a layer of chemical adhesive 62 is placed behind the element 10 to enhance the action of the fastener, and also to facilitate leveling the element against the substrate 60. Next, a sealant 64 is placed between adjacent elements 10 to prevent water entry and to simulate mortar used in conventional ornamental stone applications.

Thus, it will be seen that the present cast architectural building element provides a lightweight replacement for conventional ornamental stone blocks. In addition, it is relatively easy to positively attach to a building surface using conventional fasteners as well as chemical adhesive. By employing the present system for embedding the attachment clips, the clip is secured within, and becomes an integral part of the element.

While a particular embodiment of the embedded clip attachment for a cast architectural element has been described herein, it will be appreciated by those skilled in the art that changes and modifications may be made thereto without departing from the invention in its broader aspects and as set forth in the following claims.

The invention claimed is:

1. A cast architectural element, comprising:

a stone shell having front, end, side and rear walls defining an internal cavity, said rear walls defining a rear opening;

a core disposed in said internal cavity;

at least one attachment clip having a first portion extending from said shell, and a second portion connected to said first portion and being engaged in said core;

a layer of mesh disposed upon said core and said second clip portion; and a settable filler layer made of material distinct from said core disposed upon and encompassing said mesh and filling said rear opening, such that upon setting, said filler is captured by said shell and retains said clip in position.

2. The cast architectural element of claim 1 wherein said rear wall includes a pair of edges defining said rear opening, said edges being angled inwardly so that an inner corner of each said edge is closer to an adjacent one of said sidewalls than an outer corner, said settable filler layer being captured within said shell by said angled edges.

3. The cast architectural element of claim 1 wherein said core is made of expanded foam and is fused to interior surfaces of said shell defining said cavity through casting of said shell.

4. The cast architectural element of claim 1 wherein said first portion of said at least one attachment clip is generally parallel to, and axially offset from said second portion of said at least one attachment clip.

5. The cast architectural element of claim 1 wherein said second portion of said at least one attachment clip has at least one tooth configured for insertion into said core, and said first portion of said at least one attachment clip has at least one eyelet.

6. The cast architectural element of claim 5 wherein in said second portion of said at least one clip, said at least one tooth is provided in the form of two rows of teeth, each said at least one tooth being sharpened.

7. The cast architectural element of claim 1 wherein said filler layer is a cement-based stucco.

8. A method of forming a cast architectural element, comprising:

providing a pre-cast element having a front, end, side and rear walls defining an internal cavity, said rear walls defining a rear opening, and forming edges of said rear walls to angle inwardly;

providing a foam core disposed in said internal cavity;

providing at least one attachment clip having a first portion extending from said shell, and a second portion with at least one tooth configured for insertion into said core, and placing said clips on said element so that said second portion engages said core;

placing a layer of mesh upon said core and said second clip portion, so that edges of said mesh are beneath an inner corner of each said edge; and applying a settable filler layer upon said mesh in said rear opening, such that upon setting, said filler retains said clip in position.

9. The method of claim 8 further including removing a layer of said core at said rear opening for accommodating said mesh and said filler.

* * * * *